United States Patent [19]

Klingbeil

[11] Patent Number: 4,844,205

[45] Date of Patent: Jul. 4, 1989

[54] STOPPING CONTROL FOR AN ELEVATOR

[75] Inventor: Klaus-Jürgen Klingbeil, Berlin, Fed. Rep. of Germany

[73] Assignee: Inventio AG, Switzerland

[21] Appl. No.: 205,721

[22] Filed: Jun. 13, 1988

[30] Foreign Application Priority Data

Jun. 12, 1987 [CH] Switzerland ..... 02210/87

[51] Int. Cl.[4] ..... B66B 1/30

[52] U.S. Cl. ..... 187/116

[58] Field of Search ..... 187/112, 113, 116, 117, 187/118

[56] References Cited

U.S. PATENT DOCUMENTS

| | | | |
|---|---|---|---|
| 3,887,039 | 6/1975 | Boniek | 187/118 |
| 4,095,678 | 6/1978 | Kito | 187/116 |
| 4,161,235 | 7/1979 | Caputo et al. | 187/116 |
| 4,373,612 | 2/1983 | Caputo et al. | 187/116 |
| 4,691,807 | 9/1987 | Iwata | 187/117 |
| 4,700,811 | 10/1987 | Euin | 187/116 |

*Primary Examiner*—William M. Shoop, Jr.
*Assistant Examiner*—W. E. Duncanson, Jr.
*Attorney, Agent, or Firm*—Marshall & Melhorn

[57] ABSTRACT

An elevator system stopping control generates the difference between the actual speed value and a set point speed value on the transition from an unregulated travel phase to the regulated arrival or braking phase and prevents that difference from becoming effective so that the travel comfort is not impaired and the stopping accuracy remains assured. For this purpose, a multiplication factor is formed from the actual speed value and an associated nominal speed value by means of a divider during the travel phase before the onset point of braking and stored during the arrival phase in a memory. Stored in a travel curve memory are travel-dependent set point speed values, which values are multiplied by the factor by means of a multiplier and conducted as set point signals to a motor speed regulating circuit during the arrival phase.

11 Claims, 1 Drawing Sheet

STOPPING CONTROL FOR AN ELEVATOR

BACKGROUND OF THE INVENTION

The invention relates generally to an elevator control and, in particular, to a speed regulating circuit for controlling the stopping of an elevator car at a floor.

One type of elevator system includes a car driven by a polyphase alternating current motor which is coupled to a drive sheave. A tachometer dynamo is also coupled to the drive sheave to generate a signal representing the car speed and the rotational speed of the motor. During the arrival at a floor, the motor speed is regulable by a control circuit which is responsive to a set point transmitter which is switched in at the beginning of the arrival phase. The set point transmitter includes an integrator, which integrates an actual speed value produced by the tachometer dynamo and is connected at the output side with a subtractor, which forms a travel distance signal proportional to the difference between the actual travel distance signal formed by the integrator and a travel distance corresponding to the arrival distance to the floor at which the car will stop.

An elevator control system with a set point value transmitter according to the above description is disclosed, for example, by Swiss Patent Application No. 550 736. When control circuits of that kind, which assure great stopping accuracy, are used in elevator systems with polyphase current motors, then it is advantageous to let the motor, during the time which precedes the arrival, run unregulated at constant speed. The regulation during this time could consist only of braking the motor for each elevator to its smallest steady rotational speed with correspondingly high losses. However, difficulties arise during the transition from the unregulated to the regulated phase, since great differences between the load-dependent actual speed value and the suddenly arising set point speed value on the onset of the regulation for the arrival can arise and make themselves unpleasantly noticeable to the user of the elevator in the form of more or less hard jerks.

A control system, which avoids the aforementioned disadvantage, is disclosed in the West German Patent Application No. 3 010 234. In this case, a voltage-dependent fading regulator is provided, which during a portion of the speed-distance curve, continuously changes the influence of two mutually independent regulating circuits in dependence on the tachometer output voltage. The one regulating circuit regulates the acceleration in dependence on time, whilst the other regulating circuit regulates the speed in dependence on the travel distance. At the beginning of the braking process, the braking/time regulation is almost exclusively in engagement. Its effectiveness is reduced continuously with decreasing speed and that of the speed/-distance regulation is increased correspondingly so that the speed/distance regulation is practically exclusively in engagement at the end of the braking phase. Thereby, a jerk-free transition is attained at the onset of the braking phase and as well as an exact arrival at the floor. The above-described control circuit is relatively complicated, since apart from two braking/time regulators and one speed/distance regulator, a fading regulator including at least five operational amplifiers must be provided.

The disadvantage of the known control circuits is based on the difference, which arises on the transition from an unregulated phase of the car travel to the regulated arrival phase, between the actual speed value and the set point speed value which is generated when merely a speed-regulating circuit is effective during the entire arrival phase.

SUMMARY OF THE INVENTION

This above problem is solved by the present invention wherein the set point speed value is adapted to the actual speed value in that a multiplication factor is formed from the actual speed value and an associated nominal speed during the unregulated phase of the travel and stored during the braking phase in a memory. Stored in a travel curve memory are travel-dependent set point speed values which are multiplied by the factor and, during the braking phase, are generated as set point speed values to a speed-regulating circuit.

The advantage attained by the invention is that no jerks influencing the travel comfort arise during the transition from the unregulated phase of the travel to the regulated arrival phase even in the case of the great differences between the actual speed value and the set point speed value. Since this object is attained by a set point value transmitter having merely one regulating circuit, a simple, cost-saving solution of the initially named problem results,

BRIEF DESCRIPTION OF THE DRAWINGS

The above, as well as other objects of the invention, will become readily apparent to one skilled in the art from reading the following detailed description of the preferred embodiment of the invention when considered in the light of the accompanying drawings in which.

DESCRIPTION OF THE PREFERRED EMBODIMENT

Figure 1:
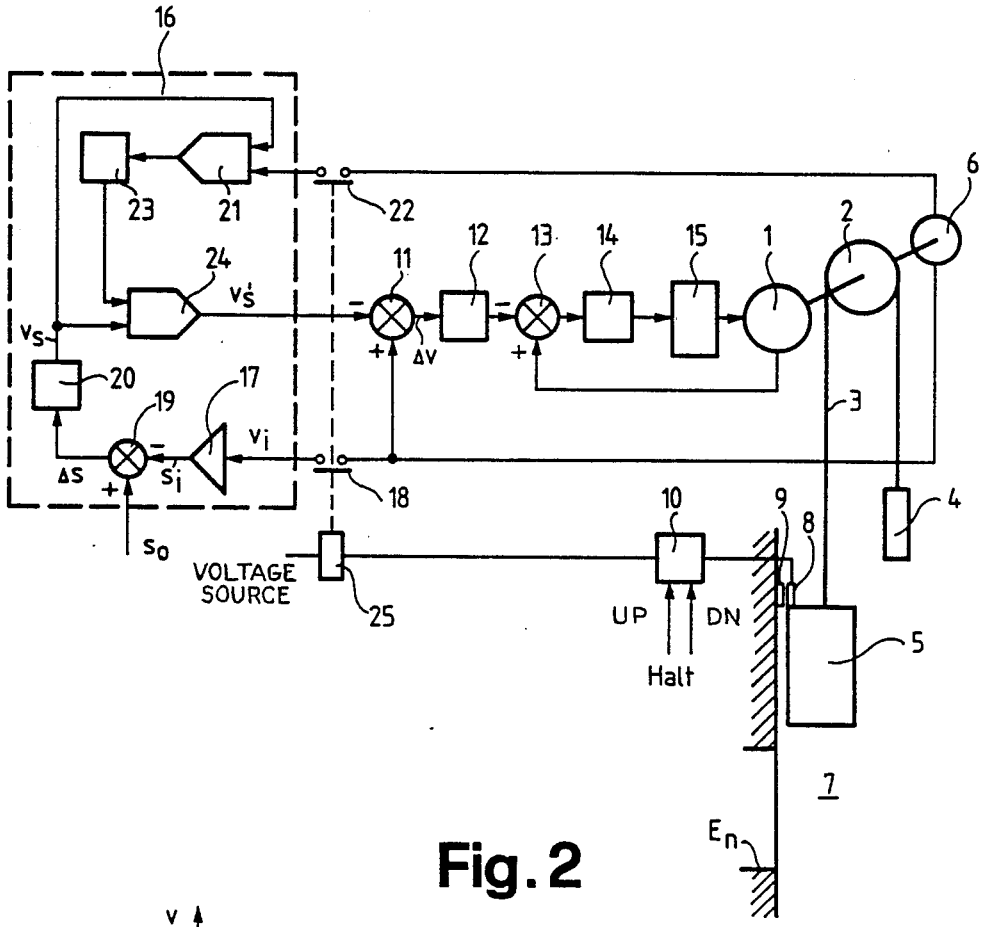
FIG. 1 is a partial schematic, partial block diagram of an elevator control system incorporating a stopping control according to the present invention.

Designated by 1 in FIG. 1 is a polyphase alternating current motor, for example an asynchronous motor, which is coupled to a drive sheave 2 to drive an elevator car 5, which is suspended by a hoisting cable 3 and balanced by a counterweight 4. The asynchronous motor 1 is coupled with a tachometer dynamo 6, which produces a voltage proportional to the actual speed of both the motor and the car. The car 5 is guided in an elevator shaft 7, wherein one floor "$E_n$" of a plurality of such floors along the elevator shaft is illustrated. Designated by 8 is a magnetic switch which is fastened to the elevator car 5 and cooperates with switching magnets 9 arranged in the elevator shaft 7. The switching magnets 9 are arranged ahead of the floors at a certain spacing corresponding to the arrival travel distance "$s_o$" of the car 5 and thereby mark the onset point of braking. The magnetic switch 8 is connected to an input of a braking onset logic circuit 10, to which stop or "Halt" signals can be applied by way of further inputs of the upward "UP" or downward "DN" travel.

The polyphase alternating current motor 1, the tachometer dynamo 6, a first subtractor 11, a first regulating amplifier 12, a second subtractor 13, a second regulating amplifier 14, and a current control 15 form a speed regulating circuit for which the purpose of stabilization is a current regulating circuit. The first subtractor 11 is connected at a first input with a set point transmitter 16 and at a second input with the tachometer dynamo 6. The first subtractor 11 forms a speed deviation signal "$\Delta v$", which is conducted as the set point current value by way of the first regulating amplifier 12 to the second subtractor 13. The second subtractor 13, from the set point current value and an actual current value from the polyphase alternating current motor 1, forms a current deviation signal which is conducted by way of the second regulating amplifier 14 to the current control 15, which, for example, consists of thyristors controlled by means of a firing angle circuit.

The set point value transmitter 16 includes an integrator 17 which is connected at the input side by way of a first contact 18 with the tachometer dynamo 6 which generates a voltage "$v_i$" corresponding to the actual speed of the motor and the car. The output of the integrator 17 is a distance signal "$s_i$" representing the actual distance travelled and is connected to an input of a third subtractor 19. The subtractor 19 has a second input connected to receive a voltage corresponding to the arrival travel distance "$s_o$" and an output which is connected with the input of a travel curve memory 20 in which travel-dependent set point speed values are stored. The subtractor 19 generates a distance deviation signal "$\Delta s$" which represents the distance remaining to arrive at the floor and which causes the memory 20 to generate the corresponding speed set point value "$v_2$".

Designated by 21 is a divider, one input of which is connected by way of a second contact 22 with the tachometer dynamo 6 and the other input of which is connected with the output of the travel curve memory 20. Connected to the output of the divider 21 is a factor memory 23, which is connected at the output side to an input of a multiplier 24, the other input of which is connected with the output of the travel curve memory 20. The output of the multiplier 24 is a set point signal "$v_s'$" which is the output of the set point value transmitter 16, and and which is connected with the first subtractor 11 of the speed regulating circuit. Designated by 25 is a relay which is connected with the output of the braking onset logic circuit 10 and a voltage source (not shown) and, on excitation, actuates the first and the second contacts 18 and 22. If the elevator control circuit includes a microcomputer, then the travel curve memory 20 and the factor memory 23 are a read only memory and a read-write memory respectively. If the circuit is analog, the memory 23 is a sample an hold circuit and the travel curve memory 20 is a root extractor which according to the relationship "$v=\sqrt{2(b)(s)}$" produces travel-dependent set point speed values, wherein the symbols "v", "b" and "s" signify speed, braking force and distance respectively.

Figure 2:
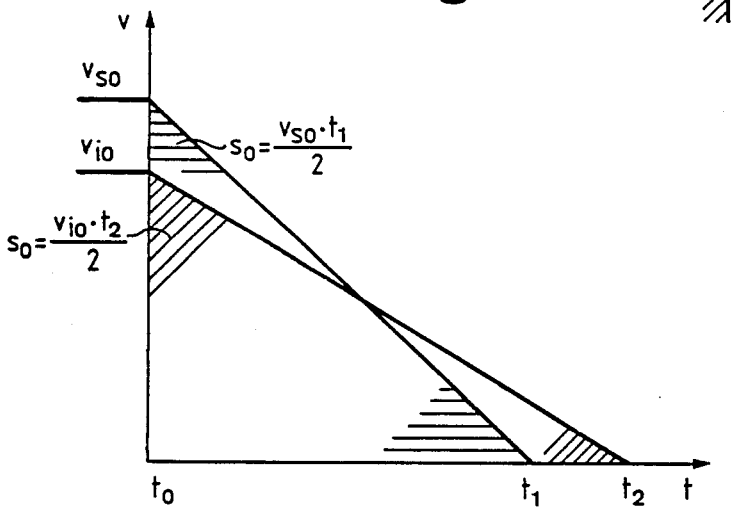
FIG. 2 is a speed versus time curve of the set point value and of the actual value regulated by the stopping control shown in FIG. 1 during the arrival phase of an elevator.

If it is assumed that the elevator car 5 travels downwardly and a stopping signal is present for the floor "$E_n$", during the travel of the car 5 past the switching magnet 9 associated with this floor, a pulse is generated and the relay 25 is excited by way of the braking onset logic circuit 10 at instant "$t_o$" in FIG. 2. In this case, the contacts 18 and 22 are actuated in such a manner that the first contact 18 is closed for the duration of the arrival and the second contact 22 is opened. From the actual speed value "$v_{io}$", at time "$t_o$", conducted by way of the second contact 22 during the unregulated phase of the travel and a nominal speed value "$v_{so}$" stored in the travel curve memory 20, a multiplication factor "$y=v_{io}/V_{so}$", is formed in the divider 21 and stored in the memory 23 for the duration of the arrival. If it is further assumed that the actual speed value "$v_{io}$" in dependence on the car loading is smaller than the nominal speed value "$v_{so}$", the actual speed values "$v_i$" now conducted by way of the first contact 18 to the integrator 17 during the duration of the arrival are now integrated into an actual travel distance value "$s_i$", which is subtracted from the arrival travel distance "$s_o$" in the third subtractor 19, wherein a remaining travel distance "$\Delta s=s_o-s_i$" is formed in correspondence with the distance still to be traversed. In dependence on the remaining travel distance, "$\Delta s$", the associated set point speed value "$v_s=\sqrt{2(b)(s)}$" is called up out of the travel curve memory 20 and conducted to the multiplier 24. Through multiplication by the factor "y" in the multiplier 24, a corrected set point speed value "$v_s'=y(v_s)$" is generated, which for the purpose of formation of the speed deviation signal "$\Delta v=v_i-v_s'$" is conducted to the first subtractor 11 of the speed regulating circuit.

The stopping control is set to stop the elevator car in an arrival time "$t_1$" if braking is begun at the nominal speed value "$v_{so}$". Since the arrival travel distance is constant and a function of the nominal speed value "$s_o=v_{so}(t_1/2)$" and is independent of the initial speed value "$v_{io}$", a somewhat longer arrival time "$t_2=s_o(2/v_{io})$" results in the assumed example, for which however the stopping accuracy is not impaired.

In accordance with the provisions of the patent statutes, the present invention has been described in what is considered to represent its preferred embodiment, However, it should be noted that the invention can be practiced otherwise than as specifically illustrated and described without departing from its spirit or scope.

What is claimed is:

1. An improvement in a stopping control for an elevator system, the system having a polyphase alternating current motor coupled with a tachometer dynamo which generates an actual speed signal, a speed regulating circuit responsive to a speed set point signal for controlling the rotational speed of the motor during the arrival phase of an associated elevator car at a floor, and a set point signal value transmitter which is switchable in at the beginning of the arrival phase and includes an integrator which integrates the actual speed value produced by the tachometer dynamo to generate an actual distance travelled signal, a subtractor which forms a distance deviation signal proportional to the difference between the actual distance travelled formed by the integrator and an arrival distance, and a travel curve memory for generating set point speed values in response to the distance deviation signal, the improvement comprising:

a divider means having one input connected with an output of the tachometer dynamo and another input connected with an output of the travel curve memory in which travel-dependent set point speed values are stored, said divider before the beginning of the arrival phase forms a multiplication factor from the actual speed signal and a nominal speed value;

a factor memory having an input connected with an output of said divider and in which said multiplication factor is stored during the arrival phase; and a multiplier having one input connected with an output of said factor memory and another input connected with the output of said travel curve memory, whereby the set point speed values in the travel curve memory, which correspond to the distance deviation signals of the subtractor, are multiplied by said multiplication factor and conducted to the speed regulating circuit as the speed set point signal.

2. The stopping control according to claim 1 wherein said factor memory is a sample and hold circuit.

3. The stopping control according to claim 1 wherein said travel curve memory is a root extractor.

4. The stopping control according to claim 1 wherein said factor memory is a read-write memory.

5. The stopping control according to claim 1 wherein said travel curve memory is a read only memory.

6. The stopping control according to claim 1 wherein said divider forms said multiplication factor by dividing the value of the actual speed signal at the beginning of the arrival phase by a predetermined nominal speed value.

7. A stopping control for an elevator system having a motor driving an elevator car, a speed regulating circuit connected to control the motor in response to a set point signal, and a tachometer driven by the motor for generating an actual speed signal, the stopping control comprising:

an integrator responsive to an actual speed signal for generating an actual distance travelled signal;

a subtractor connected to an output of said integrator and responsive to an actual distance travelled signal and a signal representing an arrival travel distance for generating a distance deviation signal;

a travel curve memory connected to an output of said subtractor for generating travel-dependent set point speed values in response to said distance deviation signal;

a divider connected to receive the actual speed signal and connected to an output of said travel curve memory to receive said travel-dependent set point speed values for generating a multiplication factor;

a factor memory connected to an output of said divider for storing said multiplication factor; and a multiplier connected to an output of said factor memory and to the output of said travel curve memory for receiving said multiplication factor and said traveldependent set point speed values for generating a set point signal for a motor speed regulating circuit.

8. The stopping control according to claim 7 wherein said divider generates said multiplication factor by dividing the value of the actual speed signal at the beginning of the arrival phase by the nominal speed value.

9. The stopping control according to claim 7 including meand for disconnecting the actual speed signal from the input of said divider and for connecting the actual speed signal to the input of said integrator at the beginning of the arrival phase.

10. The stopping control according to claim 9 wherein said means for disconnecting and for connecting includes a relay and two relay actuated contacts connected between an output of a tachometer and the inputs of each of said divider and said integrator respectively.

11. A stopping control for an elevator system having a motor driving an elevator car, a speed regulating circuit connected to control the motor in response to a set point signal, and a tachometer driven by the motor for generating an actual speed signal, the stopping control comprising:

an integrator responsive to an actual speed signal for generating an actual distance travelled signal;

a subtractor connected to an output of said integrator and responsive to said actual distance travelled signal and a signal representing an arrival travel distance for generating a distance deviation signal;

a travel curve memory connected to an output of said subtractor for generating travel-dependent set point speed values in response to said distance deviation signal;

a divider connected to receive the actual speed signal and connected to an output of said travel curve memory to receive said travel-dependent set point speed values for generating a multiplication factor;

a factor memory connected to an output of said divider for storing said multiplication factor;

a multiplier connected to an output of said factor memory and to the output of said travel curve memory for receiving said multiplication factor and said traveldependent set point speed values for generating a set point signal for a motor speed regulating circuit; and a first relay actuated contact connected between a source of the actual speed signal and an input of said multiplier and a second relay actuated contact connected between the source of the actual speed signal and an input of said divider.

* * * * *